US009429876B2

(12) United States Patent
Torimoto

(10) Patent No.: US 9,429,876 B2
(45) Date of Patent: Aug. 30, 2016

(54) TONER CASE AND IMAGE FORMING APPARATUS INCLUDING THE SAME

(71) Applicant: KYOCERA Document Solutions Inc., Osaka (JP)

(72) Inventor: Masaru Torimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/780,864

(22) PCT Filed: Jan. 21, 2014

(86) PCT No.: PCT/JP2014/051045

§ 371 (c)(1),
(2) Date: Sep. 28, 2015

(87) PCT Pub. No.: WO2014/156239

PCT Pub. Date: Oct. 2, 2014

(65) Prior Publication Data

US 2016/0054683 A1 Feb. 25, 2016

(30) Foreign Application Priority Data

Mar. 28, 2013 (JP) ..... 2013-069600

(51) Int. Cl.
*G03G 15/08* (2006.01)

(52) U.S. Cl.
CPC ..... *G03G 15/0891* (2013.01); *G03G 15/0855* (2013.01); *G03G 15/0865* (2013.01)

(58) Field of Classification Search
CPC ..... G03G 15/0891
USPC ..... 399/262, 263
See application file for complete search history.

(56) References Cited

U.S. PATENT DOCUMENTS 5,614,996 A 3/1997 Tanda
2008/0170887 A1* 7/2008 Nishimura et al. ..... 399/262

FOREIGN PATENT DOCUMENTS

JP 8-62979 A 3/1996
JP 2009-134126 A 6/2009
JP 2009-168857 A 7/2009
JP 2010-176033 A 8/2010

OTHER PUBLICATIONS

International Search Report issued in Application No. PCT/JP2014/051045, mailed Feb. 18, 2014.

* cited by examiner

*Primary Examiner* — Hoang Ngo
(74) *Attorney, Agent, or Firm* — Studebaker & Brackett PC

(57) ABSTRACT

A toner case according to the present invention includes a toner supplying portion, a screw portion 50 and a supporting portion 53. The toner supplying portion is arranged at a case body 31 to supply the toner to an apparatus main body. The screw portion 50 includes a screw shaft 51 driven to rotate at an inside of the case body 31 and the conveying blade 52 formed on the screw shaft 51 and rotating with the screw shaft 51 so that the conveying blade 52 conveys the toner to the toner supplying portion. Around the supporting portion 53, a portion of the conveying blade 52 is arranged. The supporting portion 53 is arranged closer to an inside of the case body 31 than a side wall 31*a* of the case body 31 and configured to support an end portion of the screw shaft 51.

5 Claims, 10 Drawing Sheets

TONER CASE AND IMAGE FORMING APPARATUS INCLUDING THE SAME

TECHNICAL FIELD

The present invention relates to a toner case and an image forming apparatus including the same.

BACKGROUND ART

As disclosed in Patent Document 1, an image forming apparatus, such as a laser printer, includes a toner container as a toner case to be attached to an apparatus main body. The apparatus main body is provided with an image forming portion including a developing portion.

The toner container includes a case body in which a toner as a developer is contained. The case body is provided with a toner supplying portion which supplies a toner to the developing portion of the apparatus main body. Further, at an inside of the case body, a screw portion which conveys the toner to the toner supplying portion and a stirring mechanism which stirs the toner are provided.

The stirring mechanism includes a shaft driven to rotate at the inside of the case body, and a stirring sheet attached to the shaft. The screw portion includes a screw shaft driven to rotate at the inside of the case body, and a spiral conveying blade formed on an outer face of the screw shaft and elongated along an axial direction of the screw shaft. One end of the screw shaft is rotatably supported by a bearing formed at the inside of the case body. Meanwhile, another end of the screw shaft is supported by a driving member, which transmits a driving force of a motor, at the inside of the case body.

Further, the toner contained at the inside of the case body is stirred by the stirring mechanism and is conveyed to the screw portion. The toner having been conveyed to the screw portion is conveyed to the toner supplying portion by the screw portion. Thus, the toner is supplied from the toner supplying portion to the developing portion outside the case body.

[Patent Document 1] Japanese Unexamined Patent Application, Publication No. 2010-176033

SUMMARY OF INVENTION

Technical Problem

By the way, at an outside face of a side wall of the toner container, a structure portion, such as a grip portion, which a user grips to attach the toner container to or to detach the toner container from the apparatus main body is formed in some cases. The structure portion, such as the grip portion, is formed integrally with the case body of the toner container by a metal mold.

However, when a supporting portion which supports the screw shaft is arranged so as to protrude closer to an outside than the side wall of the case body, it is difficult to form a structure, such as the grip portion, in this side wall, and therefore the flexibility of the design in the outside face of the side wall of the case body lowers in some cases.

Further, when the supporting portion and an end portion of the screw shaft are arranged closer to the outside than the side wall of the case body, the supporting portion significantly limits a layout of parts at an apparatus main body side in some cases.

By the way, when the supporting portion is arranged closer to an inside than the side wall of the case body, a toner gathered around this supporting portion is not conveyed by the conveying blade of the screw portion, and therefore there is a problem that the toner is likely to be aggregated around the supporting portion.

The present invention has been made in light of such a problem, and an object of the present invention is to efficiently convey a toner in the case body by the screw portion while arranging the supporting portion, which supports the screw shaft, closer to the inside than the side wall of the case body.

Solution to Problem

A toner case according to the present invention includes a case body, a toner supplying portion, a screw portion and a supporting portion. The case body is attached to an apparatus main body of an image forming apparatus and configured to contain a toner. The toner supplying portion is arranged at the case body so as to supply the toner to the apparatus main body. The screw portion includes a screw shaft and a conveying blade. The screw shaft is driven to rotate at an inside of the case body. The conveying blade is formed on the screw shaft and configured to rotate with the screw shaft so that the conveying blade conveys the toner to the toner supplying portion. Around the supporting portion, a portion of the conveying blade is arranged. The supporting portion is arranged closer to an inside of the case body than a side wall of the case body and configured to support an end portion of the screw shaft.

An image forming apparatus according to the present invention includes the above-mentioned toner case.

Advantageous Effects of Invention

The present invention makes it possible to efficiently convey a toner in the case body by the screw portion while arranging the supporting portion, which supports the screw shaft, closer to the inside than the side wall of the case body.

DETAILED DESCRIPTION

Hereinafter, an embodiment of the present invention will be described in detail based on the drawings. Incidentally, the present invention is not limited to the following embodiment.

<Laser Printer>

Figure 1:
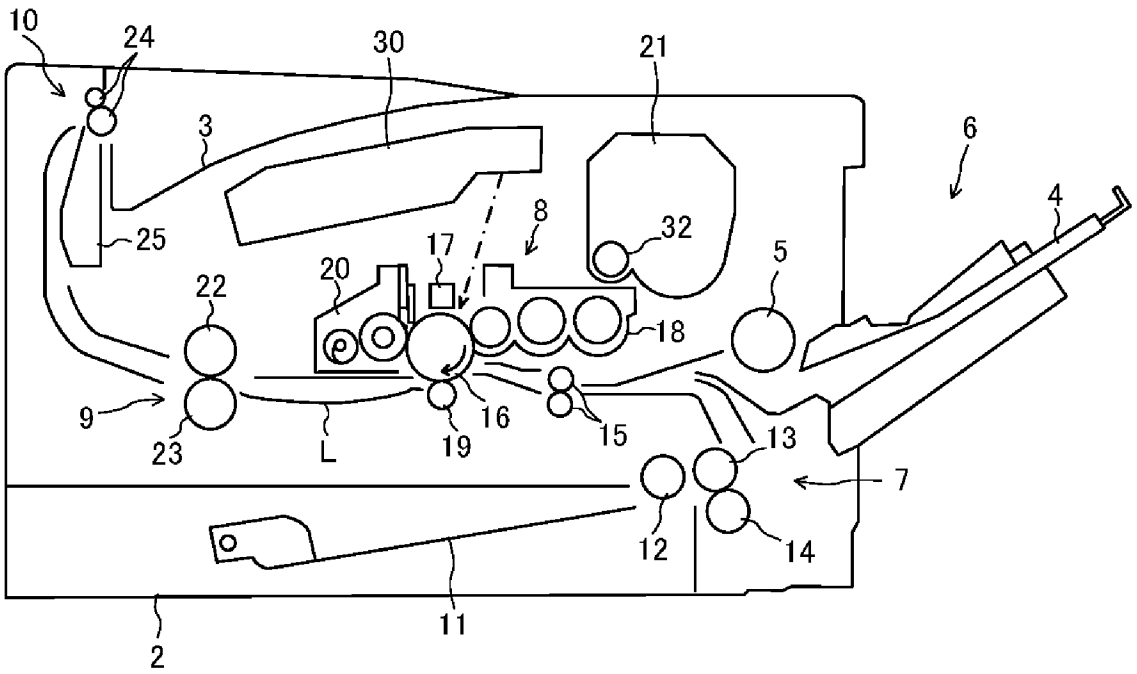
FIG. 1 is a sectional view showing a schematic structure of an image forming apparatus according to the present embodiment.
Figure 2:
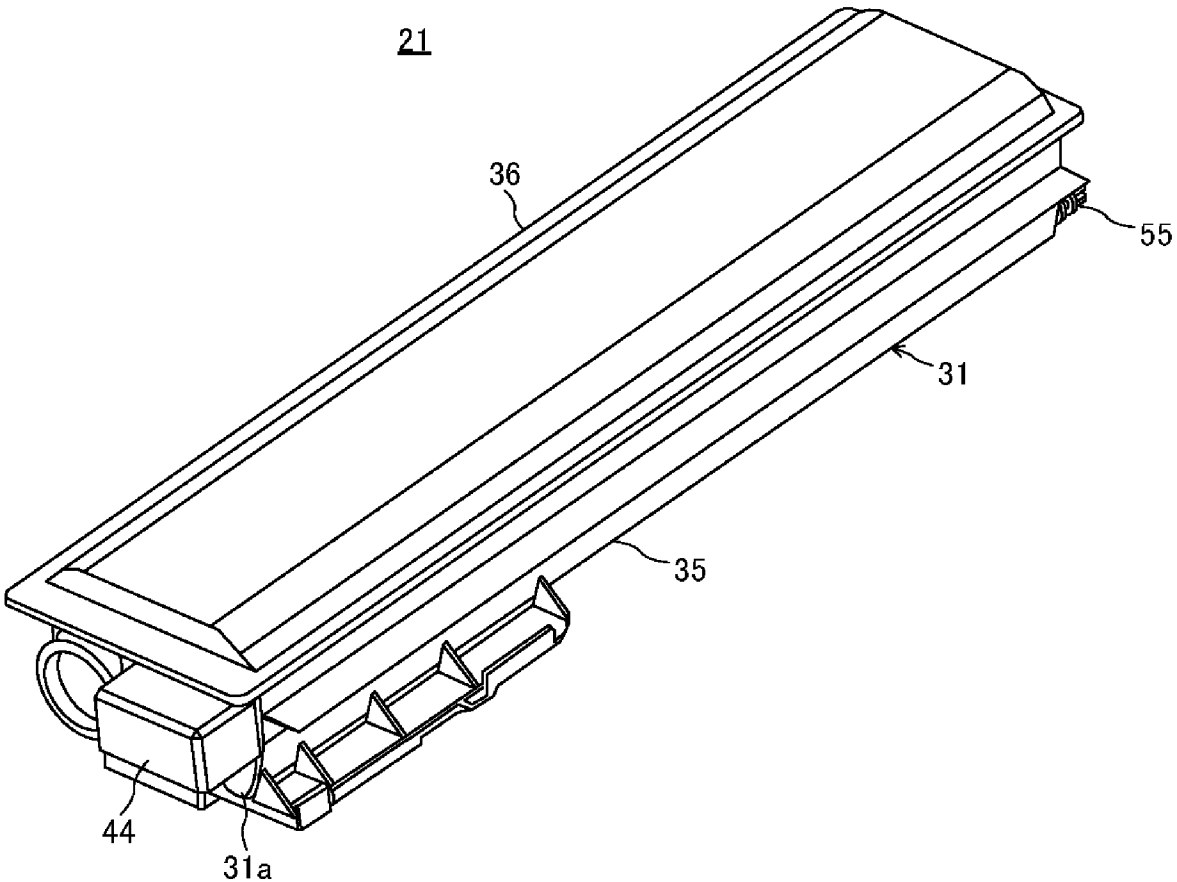
FIG. 2 is a perspective view showing an appearance of an upper part of a toner container according to the present embodiment.

FIG. 1 is a sectional view showing a schematic structure of a laser printer 1 as an image forming apparatus according to the present embodiment.

As shown in FIG. 1, the laser printer 1 includes an apparatus main body 2 and a toner container 21 as a toner case detachably attached to the apparatus main body 2.

The apparatus main body 2 includes a manual paper feeding portion 6, a cassette paper feeding portion 7, an image forming portion 8, a fixing portion 9 and a discharging portion 10. Thus, the laser printer 1 is configured to form an image on a sheet based on image data transmitted from a terminal or the like which is not shown while conveying the sheet along a conveying path L in the apparatus main body 2.

The manual paper feeding portion 6 includes a manual feeding tray 4 which is openably provided to one side portion of the apparatus main body 2, and a manual paper feeding roller 5 which is rotatably provided inside the apparatus main body 2.

The cassette paper feeding portion 7 is provided at a bottom portion of the apparatus main body 2. The cassette paper feeding portion 7 includes a paper feeding cassette 11 which contains a plurality of sheets overlaid on each other, a pick roller 12 which picks the sheets in the paper feeding cassette 11 one by one, and a feeding roller 13 and a retard roller 14 which separate the picked sheets one by one, and feed the sheets to the conveying path L.

The image forming portion 8 is provided above the cassette paper feeding portion 7 inside the apparatus main body 2. The image forming portion 8 includes a photosensitive drum 16 as an image bearing body rotatably provided in the apparatus main body 2, a charger 17, a developing portion 18, a transfer roller 19 and a cleaning portion 20 which are arranged around the photosensitive drum 16, and a laser scanner unit (LSU) 30 as an optical scanning device arranged above the photosensitive drum 16. To the developing portion 18, a toner from a toner container 21 is supplied. Thus, the image forming portion 8 forms an image on a sheet supplied from the manual paper feeding portion 6 or the cassette paper feeding portion 7.

Incidentally, the conveying path L is provided with a pair of resist rollers 15 which supply a conveyed sheet to the image forming portion 8 at a predetermined timing after making the sheet temporarily stand by.

The fixing portion 9 is arranged at a side of the image forming portion 8. The fixing portion 9 includes a fixing roller 22 and a pressuring roller 23 which come into pressure contact with each other so as to rotate. Thus, the fixing portion 9 is configured to fix a toner image, which is transferred to the sheet by the image forming portion 8, to the sheet.

The discharging portion 10 is provided above the fixing portion 9. The discharging portion 10 includes a paper eject tray 3, a pair of discharging rollers 24 which convey sheets to the paper eject tray 3, and a plurality of conveying guide ribs 25 which guide sheets to a pair of discharging rollers 24. The paper eject tray 3 is formed in a concave shape at an upper portion of the apparatus main body 2.

When the laser printer 1 receives image data, in the image forming portion 8, the photosensitive drum 16 is driven to rotate, and the charger 17 charges the face of the photosensitive drum 16.

Further, based on the image data, laser light is emitted from the laser scanner unit 30 to the photosensitive drum 16. When the face of the photosensitive drum 16 is irradiated with the laser light, an electrostatic latent image is formed on the face of the photosensitive drum 16. Meanwhile, the developing portion 18 receives a supply of a toner from the toner container 21. The electrostatic latent image formed on the photosensitive drum 16 is developed by the developing portion 18 as a toner image which becomes a visible image.

Subsequently, the sheet is pressed against the face of the photosensitive drum 16 by the transfer roller 19. Thus, the toner image of the photosensitive drum 16 is transferred to the sheet. The sheet to which the toner image has been transferred is heated and pressured by the fixing roller 22 and the pressuring roller 23 in the fixing portion 9. As a result, the toner image is fixed to the sheet.

<Toner Container>

FIGS. 2 to 5 show a configuration of the toner container 21 according to the present embodiment.

The toner container 21 is arranged above the image forming portion 8, for example. As shown in FIGS. 2 to 5, the toner container 21 includes a case body 31 in which a toner is contained and which is attached to the apparatus main body 2, a toner supplying portion 32 which is arranged at the case body 31 so as to supply a toner to the apparatus main body 2, a stirring mechanism 40 which stirs the toner at the inside of the case body 31, and a screw portion 50 which conveys the toner to the toner supplying portion 32.

The case body 31 includes a bottomed container body 35 whose upper portion is opened, and a lid portion 36 which covers the opened portion of the container body 35. The container body 35 includes a bottom portion 37 which includes an inner wall face whose cross section has an arc shape.

Figure 4:
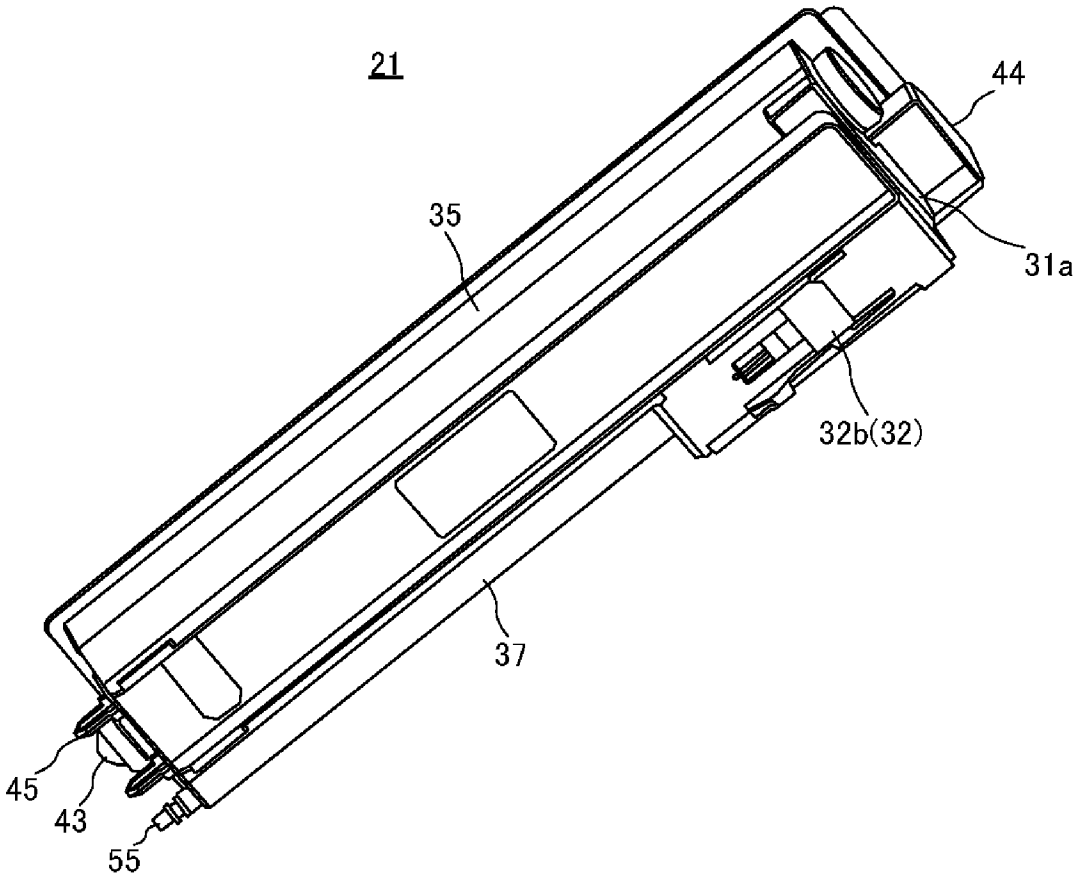
FIG. 4 is a perspective view showing an appearance of a bottom portion of the toner container.

As shown in FIG. 4, at a side wall 31*a* of the case body 31, a grip portion 44 which a user grips to attach the toner container 21 to or detach the toner container 21 from the apparatus main body 2 is formed to protrude to an outside of the case body 31.

Figure 3:
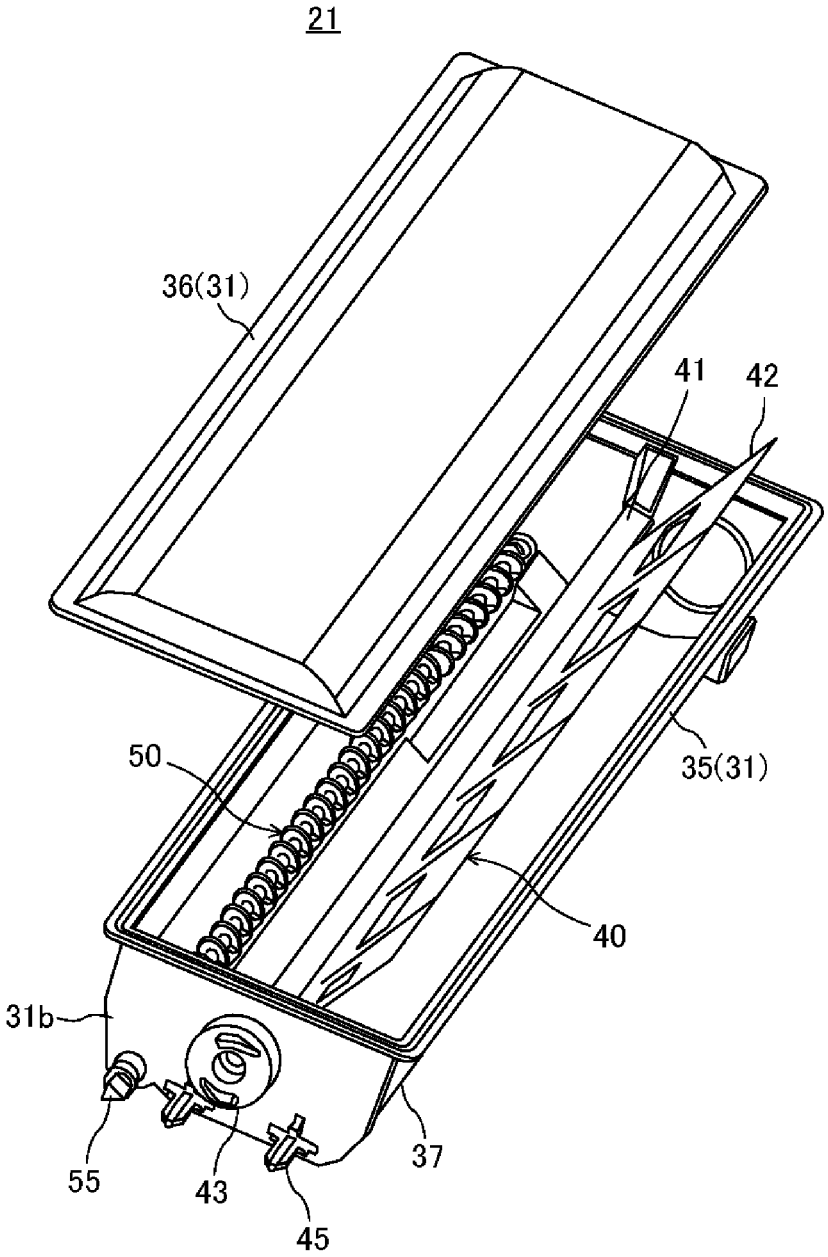
FIG. 3 is an exploded perspective view showing a structure of the toner container.

Meanwhile, as shown in FIGS. 3 and 4, at a side wall 31*b* opposing to the side wall 31*a* at which the grip portion 44 is formed, a positioning member 45 which positions the case body 31 to an apparatus main body 2 side is formed so as to protrude to the outside of the case body 31.

As shown in FIG. 3, the stirring mechanism 40 is attached to the container body 35. The stirring mechanism 40 includes a shaft 41 which is driven to rotate at the inside of the case body 31, and a stirring sheet 42 which is attached to the shaft 41.

The case body 31 extends along the shaft 41. One end of the shaft 41 is rotatably supported by the container body 35. Meanwhile, another end of the shaft 41 is coupled to a driving coupling portion 43 arranged outside the container body 35. Thus, the shaft 41 is driven to rotate by a driving force transmitted via the driving coupling portion 43.

The stirring sheet 42 is composed of a sheet member having an elasticity, and is made of a plastic film, for example. The stirring sheet 42 is formed in a rectangular shape, and has a long side portion fixed to the shaft 41. Further, another long side portion of the stirring sheet 42 which is not fixed to the shaft 41 moves while coming into contact with an inner wall face of at least the bottom portion 37 of the case body 31 in a rotating state of the shaft 41. Thus, the toner in the case body 31 is stirred by the stirring sheet 42 which is rotated with the shaft 41.

The screw portion 50 is arranged to be elongated along the shaft 41 at the inside of the case body 31. Further, the screw portion 50 is arranged above a lowermost position of the bottom portion 37 of the case body 31. Furthermore, the screw portion 50 is configured to rotate to convey a toner in the axial direction of the screw portion 50.

Figure 5:
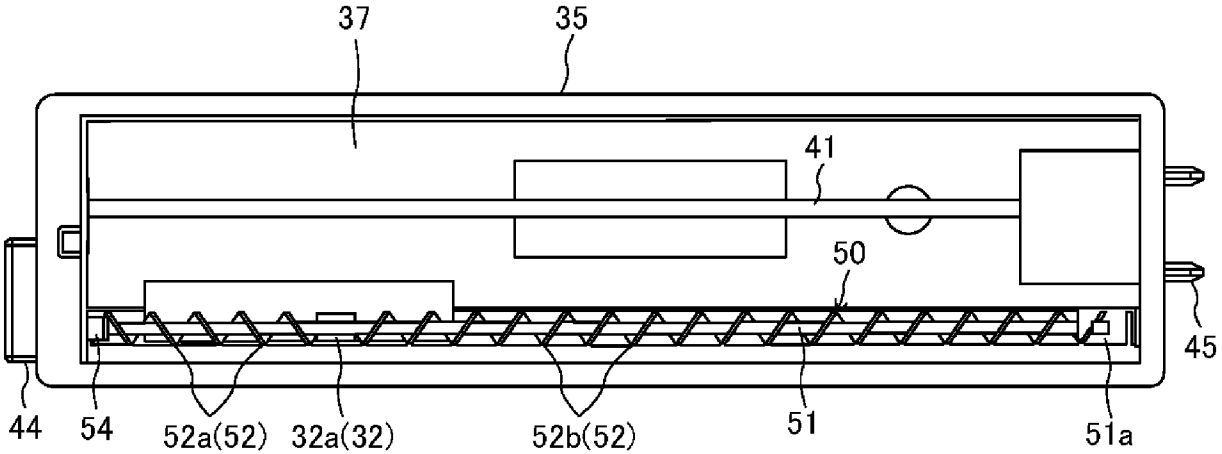
FIG. 5 is a plan view showing a structure of an inside of a container main body.

Still further, the container body 35 which is a toner conveying destination of the screw portion 50 is provided with a toner discharge outlet 32*a* and a shutter 32*b* as a toner supplying portion 32. As shown in FIG. 5, the toner discharge outlet 32*a* is provided at a position biased to a left side in FIG. 5 in the case body 31, for example.

Thus, when the shaft 41 of the stirring mechanism 40 is driven to rotate, the stirring sheet 42 is rotated while coming into contact with the inner wall surface of the bottom portion 37 of the container body 35. Thus, the toner of the bottom portion 37 of the case body 31 is scooped up toward the screw portion 50 while being stirred by the stirring sheet 42. Next, the toner is conveyed to the toner supplying portion 32 by the rotating screw portion 50. Further, the toner having arrived at the toner supplying portion 32 is supplied to the developing portion 18 of the apparatus main body 2 of the laser printer 1.

Next, the screw portion 50 and a supporting structure of the screw portion 50 will be described in detail.

Figure 6:
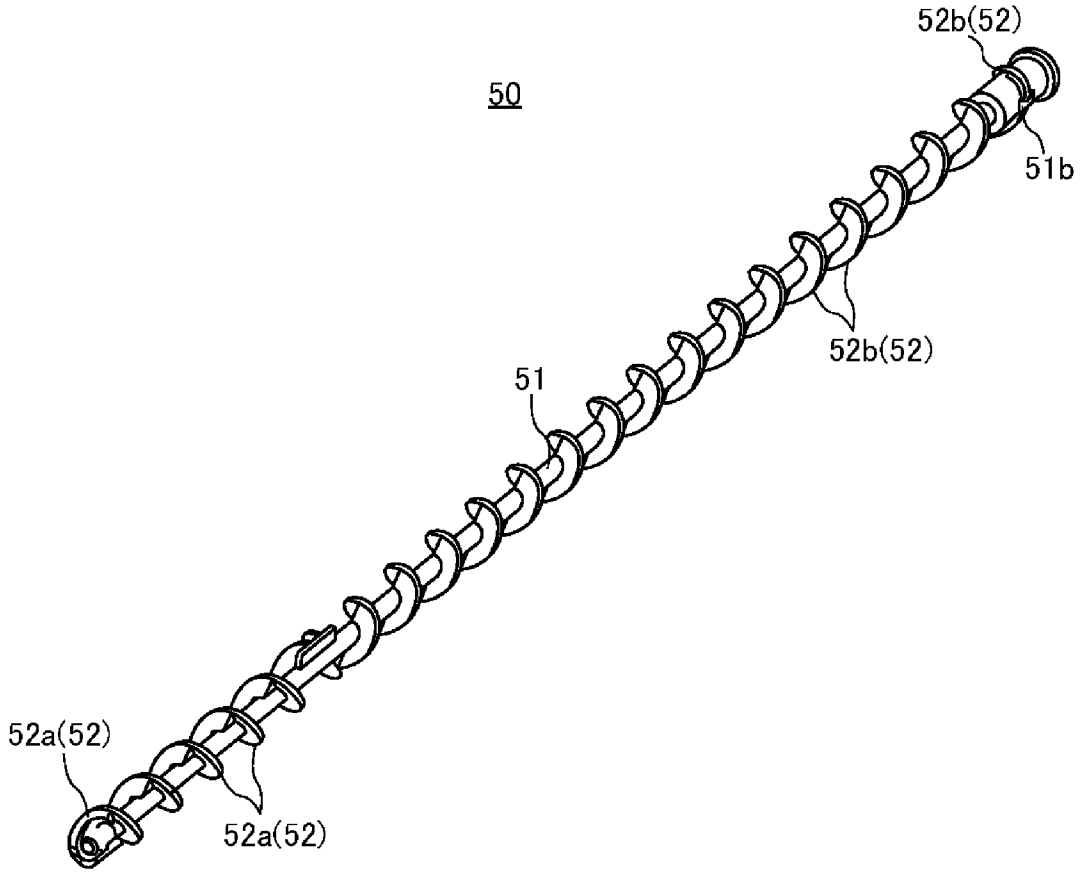
FIG. 6 is a perspective view showing an appearance of a screw portion.

As shown in FIGS. 5 and 6, the screw portion 50 includes a screw shaft 51 which extends in parallel to the shaft 41 and is driven to rotate at the inside of the case body 31, and conveying blade 52 which are formed around the screw shaft 51 and are rotated with the screw shaft 51 to convey the toner to the toner supplying portion 32.

Figure 7:
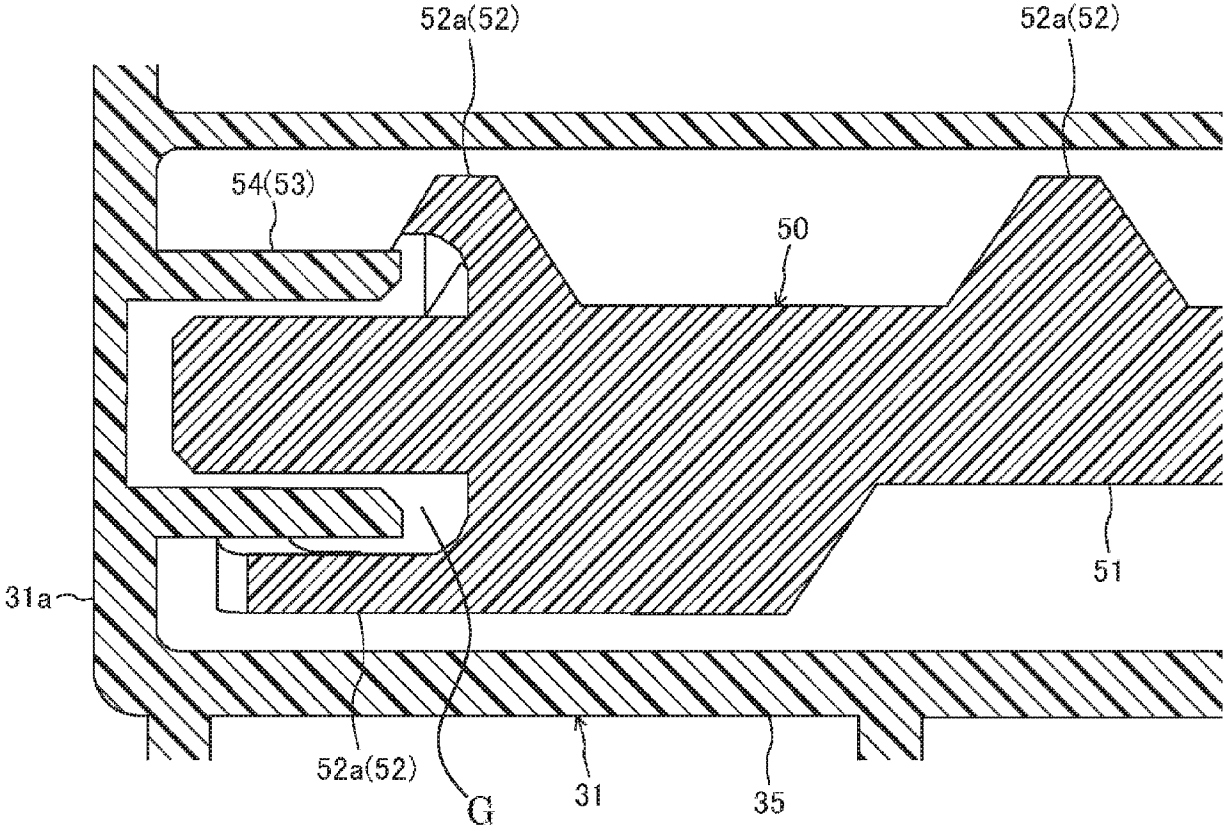
FIG. 7 is an enlarged sectional view showing an end part of the screw portion supported by a bearing.
Figure 8:
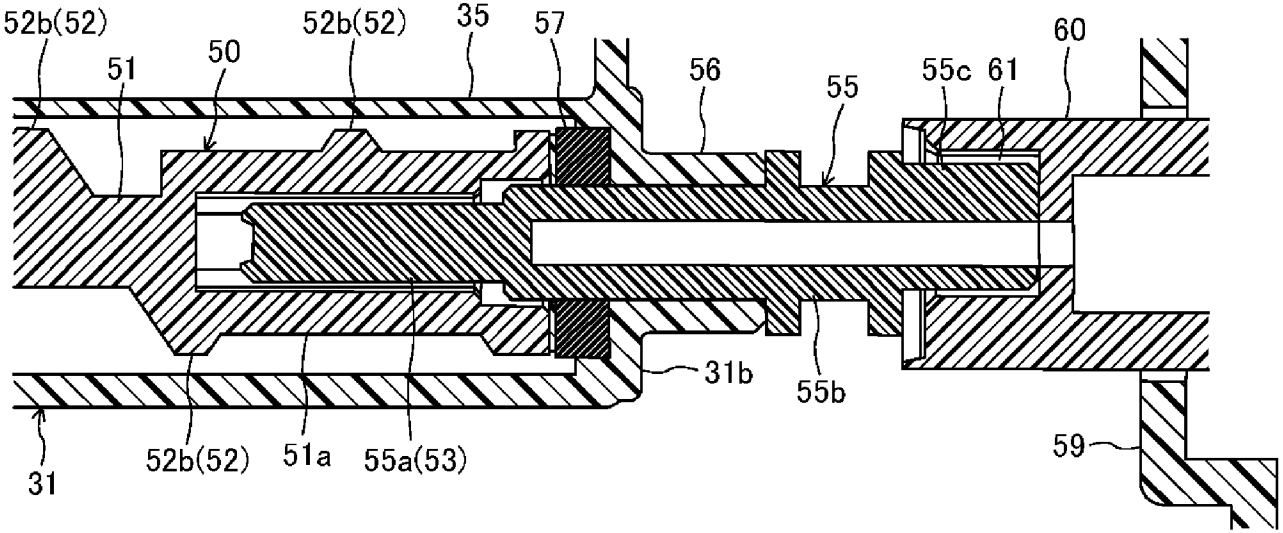
FIG. 8 is an enlarged sectional view showing an end part of the screw portion supported by a driving member.
Figure 9:
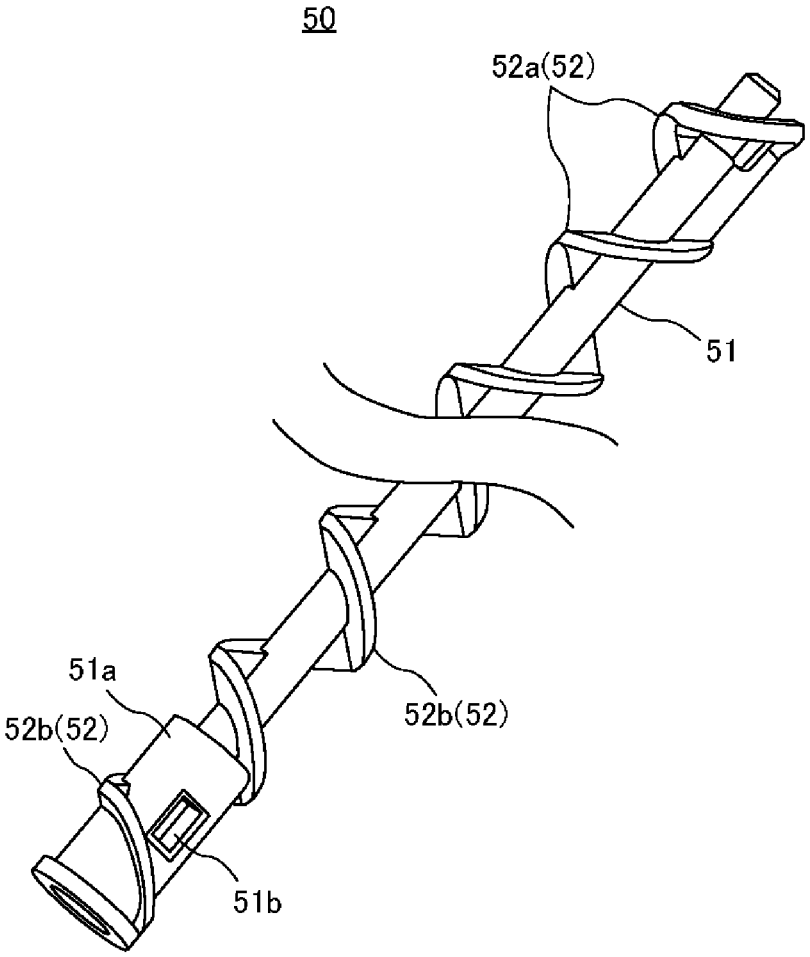
FIG. 9 is an enlarged perspective view showing end parts of the screw portion, respectively.
Figure 10:
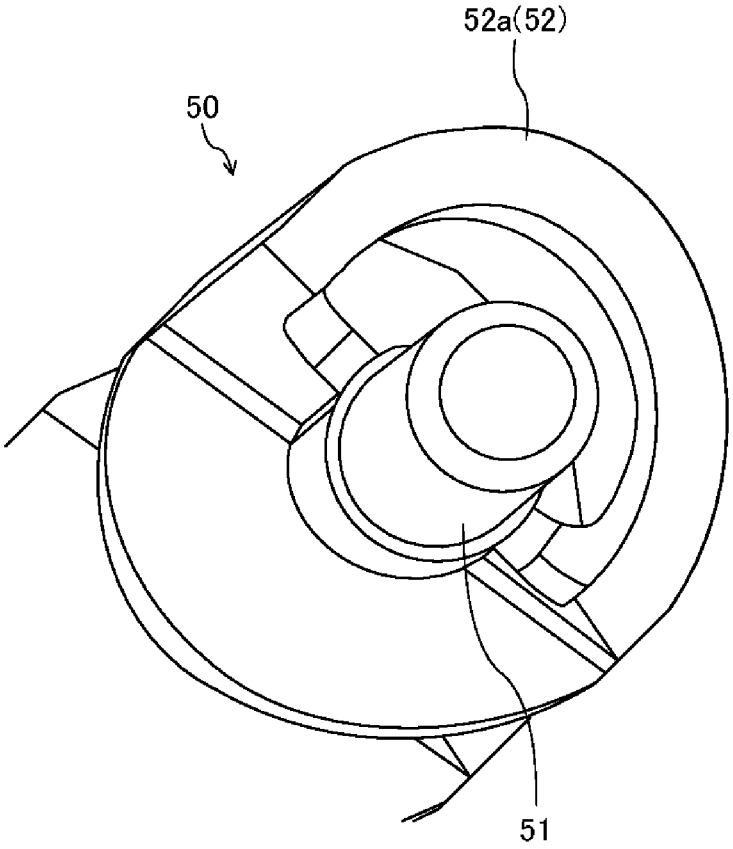
FIG. 10 is an enlarged perspective view showing the end portion of the screw part supported by the bearing.

In this regard, FIGS. 7 and 8 show enlarged vicinities of an end portion of the screw shaft 51. FIGS. 9 and 10 show enlarged appearances of the screw portion 50. As shown in FIGS. 7 and 8, the end portion of the screw shaft 51 is supported by a supporting portion 53 formed at the toner container 21.

That is, as shown in FIG. 7, one end portion of the screw shaft 51 is rotatably supported by a cylindrical bearing 54 as a supporting portion 53. The bearing 54 is arranged closer to an inside of the case body 31 than the side wall 31*a* of the case body 31, and is formed so as to protrude from the side wall 31*a* of the case body 31 to the inside of the case body 31.

Meanwhile, as shown in FIGS. 8 and 9, at the other end portion of the screw shaft 51, a cylinder portion 51*a* which extends in the axial direction of the screw shaft 51 is formed. The cylinder portion 51*a* of the screw shaft 51 is externally fitted to one end portion of a driving member 55 which transmits a driving force to the screw shaft 51. Further, the driving member 55 includes a claw portion (not shown), and this claw portion engages with an opening portion 51*b* formed on a side face of the cylinder portion 51*a* so as to fix the driving member 55 to the cylinder portion 51*a*. Thus, the screw shaft 51 is rotated with the driving member 55.

Further, one end portion of the driving member 55 to which the cylinder portion 51*a* is externally fitted is a first joint portion 55*a* as a supporting portion 53 which supports the end portion of the screw shaft 51. This first joint portion 55*a* is arranged closer to the inside of the case body 31 than the side wall 31*b* of the case body 31.

In this regard, in the container body 35, a cylindrical bearing portion 56 which is elongated to the outside of the case body 31 is formed. The driving member 55 includes a cylindrical shaft portion 55*b* which is rotatably supported by an inner circumference face of the bearing portion 56, the first joint portion 55*a* which is formed at one end side of the shaft portion 55*b*, and a second joint portion 55*c* which is formed at another end side of the shaft portion 55*b*.

Around the shaft portion 55*b* in the case body 31, a seal member 57 which prevents the toner from scattering to the outside of the case body 31 is provided. The second joint portion 55*c* is formed in a triangular prism shape elongated along a rotation axis of the driving member 55.

Meanwhile, a frame 59 at the apparatus main body 2 side is provided with a motor (not shown) as a driving means, and is provided with a main body side driving member 60 which is rotatable and transmits a driving force of the motor. At one end portion of the main body side driving member 60, a hole portion 61 which is elongated along the rotation axis of the main body side driving member 60 is formed. Further, when the second joint portion 55*c* is internally fitted to the hole portion 61, the main body side driving member 60 and the driving member 55 rotate integrally. Hence, the main body side driving member 60, the driving member 55 and the screw portion 50 are integrally driven to rotate by the driving force of the motor.

As shown in FIGS. 6 and 9, the conveying blade 52 is spirally elongated in the axial direction of the screw shaft 51. The conveying blade 52 includes a first blade 52*a* and a second blade 52*b* whose conveyance surface for conveying a toner has a different inclination from each other. As shown in FIG. 5, the first blade 52*a* is provided closer to a bearing 54 side than the toner supplying portion 32, and the second blade 52*b* is provided closer to a driving member 55 side than the toner supplying portion 32. Thus, when the screw shaft 51 is rotated, the toner at the bearing 54 side is conveyed to the toner supplying portion 32 by the first blade 52*a*, and the toner at the driving member 55 side is conveyed to the toner supplying portion 32 by the second blade 52*b*.

Further, as shown in FIGS. 7 and 8, each portion of the conveying blade 52 is respectively provided around the bearing 54 and the first joint portion 55*a* as the supporting portions 53.

That is, as shown in FIGS. 9 and 10, a portion of the first blade 52*a* is formed so as to surround the end portion of the screw shaft 51 supported by the bearing 54. At the end portion of this screw shaft 51, a gap G is formed between an outer circumference face of the end portion of the screw shaft 51 and the portion of the first blade 52*a* to allow insertion of a circumferential wall of the bearing 54. Thus, the portion of the first blade 52*a* is rotated along the outer circumference face of the bearing 54.

Further, as shown in FIGS. 8 and 9, a portion of the second blade 52*b* is formed on the outer circumference face of the cylinder portion 51*a* which is externally fitted to the first joint portion 55*a*. Thus, the portion of the second blade 52*b* is rotated integrally with the cylinder portion 51*a*.

According to the above-mentioned configuration, in the toner container 21, the screw shaft 51 is rotated in a state where the end portions of the screw shaft 51 are supported by the bearing 54 and the first joint portion 55*a* of the driving member 55 as the supporting portions 53 at the inside of the case body 31. Further, the first blade 52*a* and the second blade 52*b* of the conveying blade 52 are rotated with the screw shaft 51, so that the toner in the case body 31 is conveyed to the toner supplying portion 32. The toner having conveyed to the toner supplying portion 32 is supplied to the apparatus main body 2 of the laser printer 1.

Further, according to the present embodiment, the screw portion 50 can efficiently convey the toner in the case body 31 while the supporting parts 53 to support the screw shaft 51 are arranged closer to the inside than the side walls 31*a* and 31*b* of the case body 31.

That is, the bearing 54 as the supporting portion 53 is arranged closer to the inside of the case body 31 than the side wall 31*a* of the case body 31, so that it is possible to increase the flexibility of design of the outside face of the side wall 31*a* of the case body 31. Consequently, it is possible to form the grip portion 44 in the side wall 31*a* of the case body 31 by a suitable layout. Further, the first joint portion 55*a* as the supporting portion 53 is arranged closer to the inside of the case body 31 than the side wall 31*b* of the case body 31, so that it is possible to prevent the first joint portion 55*a* from significantly limiting a layout of the parts of the apparatus main body 2 side, such as the main body side driving member 60.

Moreover, the first blade 52*a* which is rotated with the screw shaft 51 can convey the toner gathered around the bearing 54, to the toner supplying portion 32. Further, the second blade 52*b* which is rotated with the screw shaft 51 can convey the toner gathered around the cylinder portion 51*a*, to the toner supplying portion 32. Consequently, it is possible to efficiently convey the toner in the case body 31 to the toner supplying portion 32 and, consequently, suitably prevent the toner from aggregated around the supporting portions 53 which support the screw shaft 51.

Further, the toner container 21 includes the cylindrical bearing 54 as the supporting portion 53. Consequently, the inner circumference face of the bearing 54 can rotatably support the screw shaft 51, and the first blade 52*a* of the conveying blade 52 can convey the toner gathered around the outer circumference face of the bearing 54, to the toner supplying portion 32.

Further, the toner container 21 includes the first joint portion 55*a* of the driving member 55 as the supporting portion 53 and the driving member 55 transmits a driving force to the screw shaft 51. Consequently, the driving member 55 can drive and rotate the screw shaft 51, and the second blade 52*b* of the conveying blade 52 can convey a toner gathered around the first joint portion 55*a* of the driving member 55, to the toner supplying portion 32.

Further, at the end portion of the screw shaft 51, the cylinder portion 51*a* which is externally fitted to the first joint portion 55*a* of the driving member 55 is formed, and the portion of the second blade 52*b* of the conveying blade 52 is formed at the outer circumference face of the cylinder portion 51*a*. Consequently, the portion of the second blade 52*b* of the conveying blade 52 can convey a toner gathered around the outer circumference face of the cylinder portion 51*a*, to the toner supplying portion 32.

Further, the laser printer 1 includes the toner container 21. According to this configuration, the supporting portions 53 are arranged closer to the inside of the case body 31 than the side walls 31*a* and 31*b* of the case body 31, so that it is possible to increase the flexibility of design of the outer faces of the side walls 31*a* and 31*b* of the case body 31. Consequently, it is possible to easily form the grip portion 44 which the user grips to attach the toner container 21 to or detach the toner container 21 from the apparatus main body 2, on the outside faces of the side walls 31*a* and 31*b* of the case body 31. Moreover, it is possible to prevent a toner from being aggregated around the supporting portions 53, and efficiently use the toner in the case body 31 so as to form an image.

Incidentally, in the above-mentioned embodiment, an example where portions of the conveying blade 52 are provided around the supporting portions 53 at the both ends of the screw portion 50 has been described. However, the present invention is not limited to this, and a portion of the conveying blade 52 may be provided around at least one of the supporting portions 53.

Further, in the present embodiment, the laser printer 1 has been described as an example of the image forming apparatus. However, the image forming apparatus according to the present invention is not limited to this, and may be another image forming apparatus, such as copying machine, scanner or multifunction peripheral.

INDUSTRIAL APPLICABILITY

As described above, the present invention is useful for a toner case and an image forming apparatus including the same.

The invention claimed is:

1. A toner case comprising:

a case body attached to an apparatus main body of an image forming apparatus and configured to contain a toner;

a toner supplying portion arranged at the case body so as to supply the toner to the apparatus main body;

a screw portion including:

a screw shaft driven to rotate at an inside of the case body; and a conveying blade formed spirally on the screw shaft and configured to rotate with the screw shaft so that the conveying blade conveys the toner to the toner supplying portion; and a supporting portion around which a portion of the conveying blade formed spirally is arranged, the supporting portion being arranged closer to an inside of the case body than a side wall of the case body and configured to support an end portion of the screw shaft, wherein the toner case includes a cylindrical bearing as the supporting portion, wherein the portion of the conveying blade is formed so as to surround an end portion of the screw shaft and the bearing is interposed between the end portion of the screw shaft and the portion of the conveying blade, wherein a gap is formed between an outer circumference face of the end portion of the screw shaft and the portion of the conveying blade to allow insertion of the bearing.

2. The toner case according to claim 1, including a portion of a driving member as another supporting portion, the driving member being configured to transmit a driving force to the screw shaft.

3. The toner case according to claim 2, wherein a cylinder portion externally fitted to the driving member is formed at another end portion of the screw shaft, and another portion of the conveying blade is formed on an outer circumference face of the cylinder portion so as to be rotated integrally with the cylinder portion.

4. The toner case according to claim 3, wherein the driving member includes:

a shaft portion rotatably supported by the case body;

a first joint portion to which the cylinder portion is externally fitted, the first joint portion being formed at one end side of the shaft portion; and a second joint portion formed at another end side of the shaft portion and fitted to a main body side driving member rotatably arranged at the apparatus main body.

5. An image forming apparatus comprising the toner case according to claim 1.

* * * * *